United States Patent [19]

Wales

[11] 3,994,726

[45] Nov. 30, 1976

[54] METHOD OF FORMING A RESILIENT PHOTOCONDUCTIVE ELEMENT

[75] Inventor: John Wales, Bishops Stortford, England

[73] Assignee: Xerox Corporation, Stamford, Conn.

[22] Filed: May 23, 1975

[21] Appl. No.: 580,460

Related U.S. Application Data

[62] Division of Ser. No. 464,595, April 25, 1974.

[52] U.S. Cl. ..... 96/1.5; 96/1.8; 156/84; 156/160; 156/165

[51] Int. Cl.[2] ..... G03G 5/04; G03G 5/06; G03G 5/08

[58] Field of Search ..... 96/1.5, 1.8; 156/84, 156/85, 86, 160, 165

[56] References Cited

UNITED STATES PATENTS

| | | | |
|---|---|---|---|
| 3,190,199 | 6/1965 | Clark | 96/1.5 X |
| 3,574,615 | 4/1971 | Morse | 96/1.5 |
| 3,578,445 | 5/1971 | Elchisak et al. | 96/1.5 |
| 3,697,265 | 10/1972 | Tenscher et al. | 96/1.5 |
| 3,716,359 | 2/1973 | Sheridon | 96/1.5 X |
| 3,819,370 | 6/1974 | Komiya et al. | 96/1.8 X |
| 3,849,128 | 11/1974 | Ihara | 96/1.8 X |
| 3,893,854 | 7/1975 | Honjo et al. | 96/1.5 |
| 3,928,036 | 12/1975 | Jones | 96/1.5 |
| 3,930,852 | 1/1976 | Tanaka et al. | 96/1.5 |

FOREIGN PATENTS OR APPLICATIONS

| | | |
|---|---|---|
| 1,246,480 | 5/1972 | United Kingdom |

*Primary Examiner*—Roland E. Martin, Jr.
*Attorney, Agent, or Firm*—James J. Ralabate; John E. Crowe; James P. O'Sullivan

[57] ABSTRACT

Laminated flexible photoreceptors exemplified by a core or base, a resilient elastomer layer covering the core or base, a shrunk resin film in compressive external contact with the elastomer layer, a charge conductive layer applied to the resin film and a photoconductive layer in blocking contact with the charge conductive layer. The photoreceptors are of generally improved quality producing fewer streaks or spots and with less charge migration in uniform solid areas.

22 Claims, 4 Drawing Figures

METHOD OF FORMING A RESILIENT PHOTOCONDUCTIVE ELEMENT

Figure 1:
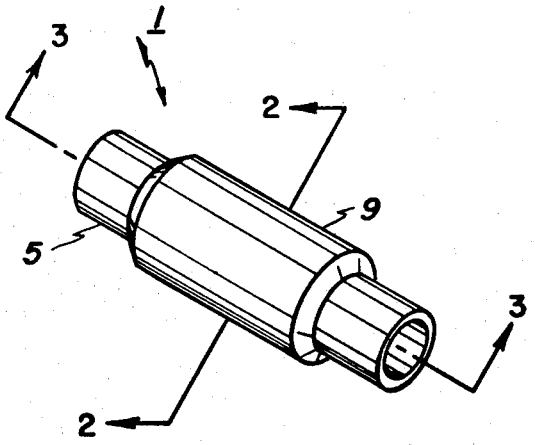

This is a division of application Ser. No. 464,595, filed April 25, 1974.

This invention relates to electrophotographic reproduction and particularly to a class of novel resilient photoreceptors.

THE PRIOR ART

British Pat. No. 1,246,480 relates to photoreceptors having a flexible plastic or metal base and an interface layer of an electrically conductive pigment dispersed in an electrically insulating organic binder.

U.S. Pat. No. 3,697,265 also utilizes a flexible belt as base for a photoreceptor wherein the photoconductive material comprises a major portion of selenium alloy and a minor portion of an insulating resin. The photoconductive structure, as described, is characterized by isolated resin particles in areas dispersed randomly within a continuous selenium alloy matrix. This patent also refers to prior photoreceptors formed when arsenic-selenium alloys are coated onto flexible substrate.

U.S. Pat. No. 3,084,043 to Gundlach relates to a liquid development process for an electrostatic latent image wherein conductive ink is presented to a photoreceptor bearing an electrostatic latent image, the ink being contained in depressions or grooves in the surface of the applicator member.

The applicator member is positioned to come into contact with a photoreceptor which is also typically cylindrical and has on its surface a latent electrostatic image.

A photoreceptor bearing the latent electrostatic image and the applicator are brought into moving contact during which time the liquid developer is drawn from the valleys to the electrostatic latent image. Typically, the developed image is then transferred to an image receiving member such as paper by pressure contact.

It hass been found, however, that the process of U.S. Pat. No. 3,084,043 is advantageously performed when either the applicator or the photoreceptor is resilient and the other member is rigid, and also that at least one of the applicator and photoreceptor is arcuate. The resilience of the applicator or photoreceptor allows the uniform application of liquid developer to the latent image while the applicator and photoreceptor are in subsstantial contact along their lines of axial tangency. Substantial contact in such case may be defined as contact sufficient to result in uniform development of the latent image on the photoreceptor. The maintaining of substantial contact between the photoreceptor and the applicator by use of a resilient photoreceptor or photoconductor is desirable in order to obtain uniform duration of time of contact between the electrostatic latent image and the liquid developer. The distance between the electrostatic latent image and the liquid developer is also more uniform when the photoreceptor or applicator is resilient. The uniformity of the surface is of less importance in achieving uniform images when the one of the applicator and photoreceptor is resilient, as the resilient member allows the applicator and photoreceptor surfaces to conform together.

THE INVENTION

The present invention provides a method of forming a resilient photoreceptor capable of enjoying the above advantages by applying a shrinkable film to a substrate having a resilient surface, shrinking said film into compressive contact with said resilient surface, applying a layer of an electrically conductive material on said film and, thereafter, applying a layer of insulating photoconductive material on said conductive material.

In general, photoreceptors falling within the present invention comrpise, in combination, a core or base member (i.e. substrate), a resilient member applied to the core or base member, at least one photoconductive layer and a member interposed between the resilient member and the photoconductive layer and containing a. a charge conductive layer in compressive contact with said resilient member, or b. a polymeric film in compressive contact with said resilient member together with a charge conductive layer arranged external thereto having, in turn, a charge blocking layer interfacing with the photoconductive layer.

The above-described invention permits the fabrication of photoreceptors to be achieved in a simple and inexpensive manner without the need for requiring fine surface finishing of the substrate. At the same time, a photoreceptor may be produced which forms uniform images with fewer streaks or spots than with prior art photoreceptors and which forms uniform solid areas.

By the expression "compressive contact" as used herein, it is meant that pressure at least sufficient to maintain the film in contact with the resilient surface preferably without substantial compression of the resilient surface.

Preferably, the resilient surface is defined by a resilient member applied to a rigid tubular mandrel, the mandrel serving as the core or base member of the photoreceptor.

In one embodiment of the invention, a resilient member, such as an elastomeric layer, is applied or adhered to the core or base. A cylindrical shrinkable synthetic resin film is then placed around the elastomer and shrunk into compressive contact with the elastomer. Then, a conductive coat is placed on the film followed by a photoconductive material.

The invention, as above described, also envisages the use of a conductive shrinkable film in which case a conductive layer is not necessary. Thus, from another aspect, the invention provides a method of forming a resilient photoreceptor comprising applying a shrinkable electrically conductive synthetic resin film to an elastomer, shrinking said resin film into compressive contact with said elastomer, and applying a layer of a photoconductive material on said resin film.

In a further embodiment, the invention includes a photoreceptor comprising a resilient surfaced base, a film in compressive contact with said base, a conductive material and a photoconductive insulating layer.

In a sstill further embodiment, the present invention utilizes a photoreceptor comprising a resilient surfaced base, a conductive film in contact with said base and a photoconductive insulating layer.

In yet another form, the invention provides a method of liquid development of electrostatic latent images which comprises moving into developing contact a resilient photoreceptor and a rigid liquid applicator, said photoreceptor having a resilient surface base, a shrunk film in compressive contact with said base, a conductive material over said film and a photoconductive material overlying the conductive material.

Figure 2:
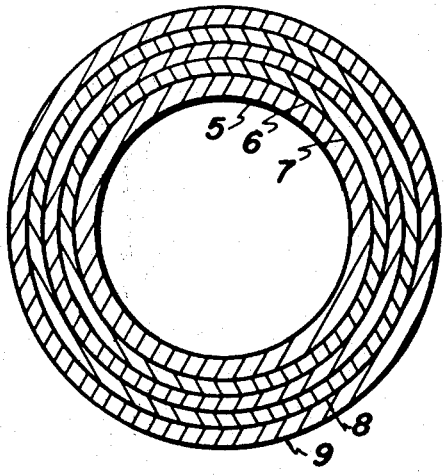
Figure 3:
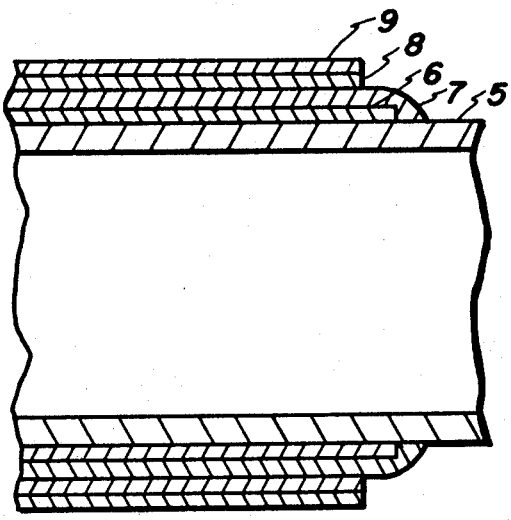
Figure 4:
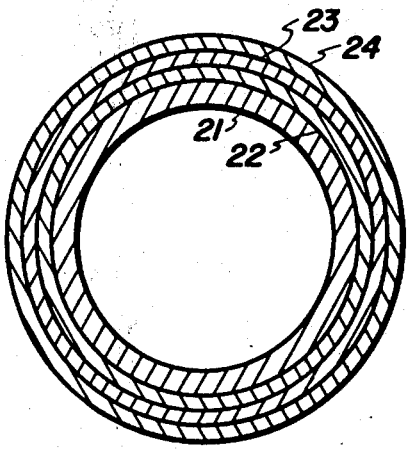

In order that the invention may be more readily understood, reference will now be made to the accompanying drawings, in which:

FIG. 1 is a perspective view of one embodiment of a photoreceptor according to the invention, FIG. 2 is a cross-sectional view along line 2—2 of FIG. 1, FIG. 3 is a cross-sectional view along line 3—3 of FIG. 1, and FIG. 4 is a cross-sectional view of an embodiment of a photoreceptor in which the shrinkable film itself is charge conductive.

Referring to FIG. 1 of the drawings there is illustrated a drum photoreceptor 1 which consists of a core tube 5 and a photoconductive surface 9 also described in FIGS. 2–3.

Referring to FIG. 2 there is illustrated a cross-section along line 2—2 of the photoreceptor of FIG. 1. The member is characterized by a core tube 5, a resilient elastomer layer 6, a shrunk resin film 7 in compressive contact with the resilient elastomer layer, a conductive layer, a conductive layer 8 and a photoconductive layer 9.

Referring to FIG. 3 there is illustrated a cross-section along line 3—3 of FIG. 1. The member is characterized by a rigid core tube 5, a resilient elastomer layer 6, a shrunk resin film 7, an electrical conductive layer 8 and a photoconductive layer 9.

Referring to FIG. 4 there is illustrated a cross-section of a photoreceptor 20 which is made using conductive shrinkable film. The member is characterized by a core 21, an elastomer layer 22, a conductive shrunk film 23 and a photoconductive layer 24.

The core or base on which the elastomer member is placed may be any material which is of sufficient strength to allow mounting of the photoreceptor when it is in use.

Typical materials are metals such as steel, stainless steel, copper and brass, and strong synthetic resins such as epoxy, polyolefin, and polyester resins which may be glass fiber reinforced. A preferred core material is aluminum because of its strength and weight. An optimum material for the core in the drum-type photoreceptor of the present invention is duralumin because of its high strength, ease of machining and light weight. This is an alloy of aluminum (about 95% by weight), copper (about 4% by weight) and small amounts of magnesium, manganese, iron andd silicon.

Some roughness of the core can be tolerated. For example, a standard lathe finish is suitable. A surface finish of about 1 to 5 microns roughness CLA (Center Line Average) is preferred as a certain amount of roughness assists in bonding the elastomer layer to the core.

The resilient member or layer may be applied to the substrate by any suitable method. Typical methods include dipping a substrate core in uncured elastomer, doctoring uncured elastomer or elastomer in solution onto the substrate or placing a thin preformed resilient elastomer sleeve onto the substrate. In the instance where a preformed sleeve is used, it may be adhesively attached to the core or the elastomer may be held against the core by the pressure caused by the shrunk film. If the elastomer is applied in the uncured form, it normally is cured prior to application of the shrinkable resin film. However, it is possible that curing is completed during or after shrinking of the film.

The resilient layer for use in the invention is typically an elastomer selected such that the completed photoreceptor will possess a hardness which is suitable for the desired use. A Shore hardness of 30° to 90° produces satisfactory photoreceptors. More specifically, a hardness of about 50° to 80° is preferred to give photoreceptors good quality images and long life spans. The optimum Shore hardness of the resilient elastomer for photoreceptors utilizing vacuum deposited selenium layers is about 60° to 70°; at this range there is the least tendency for the photoconductive material to crack and flake off. Obivously, when more flexible photoconductive material such as the wellknown binder layers are employed, however, considerably wider latitude in Shore hardness can be tolerated without encountering flaking of the photoconductive layer. The term "Shore hardness" when used in this specification refers to a measurement on a Shore A. durometer. A completed photoreceptor normally has substantially the same hardness as the resilient layer.

Any suitable resilient material which possesses the required hardness may be used in the invention. Typical resilient materials include, for instance, acrylonitrile-butadiene copolymmers, ethylene-propylenediene rubbers, silicone rubbers, chlorinated rubbers, natural rubber, butadiene-styrene copolymers, sodium polysulfide and polyurethane elastomers. A preferred resilient elastomer material is neoprene rubber, which has good resistance to chemical attack. The optimum resilient elastomeric composition is butyl rubber because of its resistance to chemical attack by ink and other chemicals, and its long uniformly resilient life. Butyl rubber, for this purpose, can be a copolymer of isobutylene (97%) and isoprene (3%).

The surface finish of the resilient material should be characterized by a smoothness sufficient to avoid causing blemishes on the surface of the photoreceptor. Generally, such smoothness may be obtained by grinding. After grinding, the surface should have a finish of not more than about 5 microns roughness CLA and preferably a finish of about 1 micron roughness CLA.

Any shrinkable synthetic resin film which is capable of withstanding the vacuum and heat of the vacuum coating step is suitable for the invention. The films typically have a thickness of greater than about 0.0005 inch in order to have sufficient strength. The upper thickness is only limited by the flexibility and shrinkage of various materials, but generally the upper range of shrinkable film thickness is about 0.1 inch. The preferred range is between about 0.015 inch and 0.002 inch. The films are formed by any of the known orientating processes used to form shrinkable films. Typical materials for shrinkable synthetic resin films include polyblends of acrylonitrile-butadiene-styrene (ref. CH Basdekis, "ABS Plastics", Reinhold Plastics Application Series [1964]) polyvinyl chloride, polyamide acrylics, i.e., methyl methacrylate, celluosic resins, i.e., cellulose acetate, polystyrene polymer, polyesters, polyurethanes, and copolymers of the various shrinkable resins mentioned in this paragraph. Suitable for the process are other shrinkable films such as those formed from polycarbonates and polyvinyl chloride. Preferred materials for the shrinkable film are shrinkable oriented polyethylene and oriented polypropylene films because of their good strength and temperature resistance. The optimum shrinkable resin films for the invention are polyethylene terephthalate films about 0.002 inch thick formed by the reaction of ethylene glycol and terephthalic acid and known by the trademark Mylar. Mylar films are preferred because of their heat resistance and desirable surface properties which allow a good bond with the conductive layer which is placed onto the film.

It is possible to use a conductive shrinkable film and thereby alleviate the need for a conductive interface. Typical conductive shrinkable films include ABS, acrylics, cellulosic resins, polyesters and polycarbonates containing carbon black, iron particles, copper particles or other conductive additives such as those listed in U.S. Pat. No. 3,585,835. The conductive particles typically have an average particle size of less than about 15 microns. Preferred conductive shrinkable films are polypropylene and polyethylene, which have good strength, loaded with carbon black, iron particles, or copper phthalocyanine. The optimum shrinkable synthetic resin film is Mylar polyester filled with about 8 – 40% by weight fine carbon particles of an average particle size of less than about 15 microns. This film is optimum due to its strength, and its good heat and chemical resistance.

The shrunk film is typically covered with a layer of conductive material. The conductive material may have thickness of up to about 0.001 inch. It typically is between about 0.00001 and 0.0005 inch thick. The conductive material serves as the conductive base for the photoconductive material and may also serve to bind the photoconductive material to the base of the photoreceptor. Any suitable conductive material may be used. Typical conductive materials are steel, chrome, bismuth, copper iodide and brass. The optimum material for the conductive material is aluminum as this is a well-known conductive substrate material whose properties are well known.

The conductive material typically has applied to it an interface layer. The interface layer, as is well known in the art, lessens the tendency of the conductive substrate to inject charge into a photoconductive material overlying the conductive substrate. The interface layer typically has a thickness of less than about 3 microns. Any suitable interface material may be used. Typical materials are brass oxide, oxidized bismuth and the polyblends of polycarbonate and polyurethane disclosed in U.S. Pat. No. 3,717,821. The optimum interface layer is aluminum oxide. The aluminum conductive material is typically applied by vacuum deposition and then the interface of aluminum oxide is formed by exposure of the aluminum to air. The aluminum conductive material with an aluminum oxide interface is the optimum material since it is a well-known conductive material whose properties in photoreceptors are well understood.

The interface layer thickness varies with the material being used. The thickness for aluminum oxide is between about 20 and 30A. The preferred thickness for the polyblend of polycarbonate and polyurethane is about 1 micron. Generally, a longer life is obtained by the use of a thinner electrical conductive layer. The interface layer is of a thickness such that the photoconductive material is able to discharge evenly when exposed to electromagnetic radiation and does not allow charge injection into the photoconductive material.

The insulating photoconductive material is typically applied to the conductive material having an interface layer by vacuum deposition. Obivously, other suitable means may be utilized for forming the insulating photoconductive layer. Typical techniques for forming layers include laminating and casting. Typically, the application of the photoconductor would immediately follow the application of the interlayer which is also applied by vacuum deposition.

Any suitable insulating photoconductive material may be used for the invention. Typical photoconductive materials include zinc oxide in a binder or selenium alloy such as those alloys found in the U.S. Pat. to Mengali No. 2,745,327 and the U.S. Patent to Paris No. 2,803,541. Other typical insulating photoconductive materials are the organic insulating photoconductive materials such as those disclosed in U.S. Pat. Nos. 3,357,989; 3,484,237; 3,037,861; and 3,287,123. Satisfactory photoconductive compositions are amorphous selenium alone or alloyed with arsenic, tellurium, antimony, or bismuth, or amorphous selenium alloys doped with halogens. Preferred photoconductive compositions are alloys of arsenic and selenium as disclosed, for example, in U.S. Pat. No. 2,822,054 and selenium such as disclosed in U.S. Pat. No. 2,970,906. The optimum photoconductive materials are the arsenic selenium chloride alloys disclosed in U.S. Pat. No. 3,312,548 and are considered optimum because of good flexibility and known ability to produce high quality images.

The photoconductive layer should be thick enough to hold a charge but thin enough to be capable of discharge by electromagnetic radiation. Reference is made to U.S. Pat. No. 3,713,821 for details of vapor deposition of photoconductive material. Any thickness less than about 80 microns is suitable for the process although of course as the photoconductive layer becomes thinner less voltage is held by the photoconductor and development becomes difficult. A preferred thickness range is about 30 – 80 microns as this range shows good adhesion. The optimum thickness for selenium photoconductive layers is about 40 – 60 microns, as this thickness provides good images while having the least tendency to crack and peel.

While the above description has dealt primarily with drum-type photoreceptors, the invention encompasses photoreceptors of other shapes which may be formed by the process of the invention in which a shrinkable film is brought into compressible contact with an elastomer. The film coated elastomer base of the invention may be formed by placing a rigid plate coated with elastomer on one or both sides into a shrinkable tube and then shrinking the tube into compressive contact with the elastomer. Another method would be to take a rigid plate coated with elastomer on one side and then cover the elastomer surface of the plate with a shrinkable synthetic resin film which is tacked to the edges or undersurface of the plate prior to shrinking of the film. Known overcoating materials can be applied to protect the photoconductive surface of the photoreceptor from abrasive and chemical damage. Typical overcoating materials are cellulose ethers and esters, epoxies, polyester and those disclosed in U..S. Pat. Nos. 3,140,175; 3,251,686 and 3,434,832.

In some cases, it may be desirable to use binder coats to aid bonding of the conductive interlayer to the synthetic resin film. While the process has been described with heat shrinkable films it is considered that the process could be performed with films which shrink in response to exposure to solvent vapors. It is also considered within the scope of the invention to shrink a tubular resin film by placing it about the elastomer surfaced core and then pulling the ends of the film to stretch the film and at the same time narrow its diameter to bring it into compressive contact with the elastomer. The film would typically be heated during stretching. Any suitable stretchable film could be used. Typical films are those composed of cellulose acetate, polyethylene, polyvinyl chloride or polycarbonate polymers. It is also within the scope of the invention to support a resilient surfaced belt on a rigid support and then shrink a film into contact with the resilient surface. The belt would typically have a steel, stainless steel or nickel substrate coated with the above-listed resilient materials.

The following examples further describe the preferred forms of the invention. All limitations are by weight unless otherwise set forth.

EXAMPLE 1

A duralumin core about 2½ inches inside diameter and about 3 1/34 inches outside diameter and about 14.5 inches long formed is coated with about ⅛ inch thickness of 40° – 50 ° Shore hardness neoprene rubber and ground to a surface finish of about 1 micron CLA. A Maylar heat shrinkable sleeve of about 0.002 inch thickness and about 3.5 inches diameter is placed over the neoprene rubber. A hot air gun is then used to uniformly shrink the Mylar into compressive contact with the neoprene elastomer. The Mylar surface is thereafter aluminized to a thickness of about 1000 Angstroms by vacuum deposition and exposed to air to form an aluminum oxide interface. A coating of amorphous selenium of about 30 microns thickness is then applied by vacuum deposition as described, for instance, in U.S. Pat. Nos. 3,490,903; 3,312,548; 2,970,906 and 2,753,278. The completed photoreceptor produces xerographic images of good line quality free from streaks.

EXAMPLE 2

Example 1 is repeated using a core of about 4 inches inside and 4¼ inches outside diameter and a length of about 10.5 inches. In addition, the neoprene rubber layer has about 80° Shore hardness, and an aluminum layer of about 0.003 inch is deposited thereon by electrolytic deposition. The resulting photoreceptor produces good quality prints.

EXAMPLE 3

Example 1 is repeated using a Mylar layer of about 0.001 inch thickness and a photoconductive layer constituting amorphous selenium alloyed with about 0.3% arsenic and deposited by vacuum deposition to a thickness of about 45 microns. The completed photoreceptor produces images of good line quality free from streaks and having substantially uniform density.

EXAMPLE 4

A core of duralumin having about 2½ inches inside diameter, 3½ inches outside diameter and 14.5 inches length is coated to ¼ inch thickness with butyl rubber (about 40° Shore hardness) with a doctor blade. The rubber is then heated to cure and ground to a surface finish of about 1 micron CLA. A 3½ inches diameter 0.002 inch thick shrinkable Mylar film containing 12% by weight carbon black having an average particle size of about 14 microns is then placed over the elastomer and heat shrunk into contact with the elastommer. Thereafter, a coating of selenium-arsenic alloy of the composition described in Example 1 of U.S. Pat. No. 3,713,821 is vacuum deposited in accordance with the process set forth in that example. The resulting photoreceptor is found to produce satisfactory images.

While particular embodiments have been described above, it will be appreciated that various modifications may be made without departing from the scope of the invention as defined in the appended claims.

What is claimed is:

1. A method of forming a resilient photoreceptor comprising applying a shrinkable polymeric film to a substrate having a resilient member applied thereto, shrinking said film into compressive contact with said resilient member, applying a layer of electrically conductive material on said film and, thereafter, applying a layer of less than about 80 microns of insulating photoconductive material to said conductive material.

2. A method of claim 1, in which said shrinkable film is polyethylene terephthalate formed by reacting ethylene glycol and terephthalic acid.

3. A method of claim 1, in which said shrinkable film is formed of at least one of polyethylene, polypropylene, polycarbonate or a polyamide resin.

4. A method as claimed in claim 1 in which the shrinkable film has a thickness of between about 0.00001 and 0.0005 inch.

5. A method as claimed in claim 2 in which the shrinkable film has a thickness of between about 0.00001 and 0.0005 inch.

6. A method as claimed in claim 3 in which the shrinkable film has a thickness of between about 0.00001 and 0.0005 inch.

7. A method as claimed in claim 4 in which said shrinkable film has a thickness of about 0.001 inch.

8. A method as claimed in claim 1 in which said film is a synthetic resin film of a thickness greater than 0.0005 inch.

9. A method as claimed in claim 2 in which said film is a synthetic resin film of a thickness greater than 0.0005 inch.

10. A method as claimed in claim 3 in which said film is a synthetic resin film of a thickness greater than 0.0005 inch.

11. A method as claimed in claim 1 in which the resilient surface is an elastomer mounted on a rigid tubular core.

12. A method as claimed in claim 1 in which said resilient surface is neoprene, natural rubber, a butadiene-styrene copolymer or a polyurethane elastomer.

13. A method as claimed in claim 1 in which said resilient surface is butyl rubber.

14. A method as claimed in claim 1 in which said shrinking is caused by the application of heat.

15. A method as claimed in claim 1 in which shrinking is caused by the axial stretching of a tubular film.

16. A method as claimed in claim 1 in which said resilient surface has a Shore hardness between about 30° and 90°.

17. A method as claimed in claim 16 in which said resilient surface has a Shore hardness of between about 60° and 70°.

18. A method as claimed in claim 1 in which said electrically conductive material is aluminum oxide.

19. A method as claimed in claim 1 in which said photoconductive material is amorphous selenium, a selenium arsenic alloy or selenium alloyed with arsenic and chlorine.

20. A method of forming a resilient photoreceptor comprising applying a shrinkable electrically conductive synthetic resin film to an elastomer applied or adhered to a core or base, shrinking said resin film into compressive contact with said elastomer, and applying a layer of a photoconductive material on said resin film.

21. A method as claimed in claim 20 in which said conductive film is formed of a polyester which contains carbon black.

22. A method as claimed in claim 20 in which the photoconductive material is an alloy of selenium with arsenic and chlorine.

* * * * *